United States Patent [19]

Paul et al.

[11] 4,043,092

[45] Aug. 23, 1977

[54] CLIP FOR ATTACHING INSULATION AND THE ASSEMBLY THEREOF

[75] Inventors: George W. Paul, Des Plaines; Henry A. Balinski, Hoffman Estates; Paul S. Quigg, Barrington; John H. Crumbaugh, Des Plaines, all of Ill.

[73] Assignee: United States Gypsum Company, Chicago, Ill.

[21] Appl. No.: 402,881

[22] Filed: Oct. 2, 1973

[51] Int. Cl.[2] ..... E04B 1/38

[52] U.S. Cl. ..... 52/712; 52/727

[58] Field of Search ..... 52/727, 728, 361, 423, 52/725, 712–715, 357, 358, 758 K, 724, DIG. 8, 364, 362, 363; 85/13

[56] References Cited

U.S. PATENT DOCUMENTS

| | | | |
|---|---|---|---|
| 2,100,624 | 11/1937 | Beckwith | 52/361 X |
| 2,282,624 | 5/1942 | Upson et al. | 52/361 X |
| 2,282,631 | 5/1942 | Winshlp | 52/361 X |
| 2,370,052 | 2/1945 | Lindelow | 52/361 |
| 3,748,815 | 7/1973 | Parker | 52/727 X |

FOREIGN PATENT DOCUMENTS

| | | | |
|---|---|---|---|
| 829,504 | 3/1960 | United Kingdom | 52/725 |

*Primary Examiner*—Price C. Faw, Jr.
*Assistant Examiner*—Carl D. Friedman
*Attorney, Agent, or Firm*—Samuel Kurlandsky; Robert H. Robinson; Glenn W. Ohlson

[57] ABSTRACT

A clip and the assembly of the clip with a structural member and insulative layers, the clip being releasibly self-attached to projecting edge portions of the member so as to have two impaling projections for impaling the layers.

11 Claims, 9 Drawing Figures

CLIP FOR ATTACHING INSULATION AND THE ASSEMBLY THEREOF

BACKGROUND OF THE INVENTION

Structural members such as steel columns, beams, girders, plates, and the like are commonly sheathed, wrapped, or otherwise enclosed by layers of insulation for protection. It is conventional to secure the insulation in place by the means of impaling clips of one form or another. U.S. Pat. No. 2,100,624 illustrates on example of such a clip, and its use to attach a layer of fireproofing material around a beam. In that case, only one end of a sheet metal clip is used to penetrate the layer, as the opposite end is used to clamp the clip over a flange of the member. Additional clips would have to be used to impale insulation at a different location on the member. A further disadvantage is that the sheet metal form of the clip requires considerable metal. Still another example is shown in U.S. Pat. No. 2,370,052, wherein asbestos fibers are held in place by a double-pronged sheet metal clip, the center portion of which is welded to an angle beam.

Recently, it has been discovered that a layer or layers of mineral wool felt, when held adjacent to structural members by clips, provide fire resistance sufficient to provide a fire rated structural member. This is disclosed and claimed in United States application Ser. No. 103,231 filed on Dec. 31, 1970, commonly owned with the instant application. Only one end of each clip is disclosed therein as being capable of impaling the felt.

SUMMARY OF THE INVENTION

The invention relates to a clip, and its use to insulate a structural member, which may provide two impaling projections per clip rather than one, while also providing for self-attachment and stability of the clip so as to eliminate complicated steps such as welding, wire-tying, and the additional parts required in such steps. More specifically, there is provided a clip, and the combination thereof with a structural member and a layer or layers of insulation secured or attached to a projecting edge of the member by the clip, the clip comprising an edge gripping portion, and attachment means on said clip for separately attaching two layers of insulation to the structural member, whereby the clip may secure a plurality of angled layers or sheets of preformed insulation about a structural member by gripping the edge thereof without the use of any additional fastening means. The preferred form of the clip may attach the insulation by the steps of clamping the clip to the member edge portion so as to project the prongs of the clip outwardly away from the member, impaling a first layer or sheet of insulation over one prong of the clip to protect one surface of the member edge portion, and impaling another layer or sheet of insulation over the other prong of the clip to protect another surface of the member edge portion.

Accordingly, it is an object of the invention to provide a clip for attaching protective insulation to a structural member, and the method and assembly of these elements, wherein each clip may simultaneously mount two different portions of the insulation, and still be secured to the member without requiring additional attachment means or steps.

It is a related object of the invention to provide a clip, method, and assembly of clip and insulation on a structural member wherein the clip is stable to torque or twisting forces applied thereto.

It is another object of the invention to provide such a clip, method, and assembly wherein the clip will accommodate structural members with varying projecting edge thicknesses.

Yet another object of the invention is to provide such a clip, method, and assembly wherein the clip is readily moved to alternate locations on the structural member.

Other objects and advantages will become apparent upon reference to the following description of the drawings and of the preferred embodiments.

DESCRIPTION OF THE PREFERRED EMBODIMENTS

The invention as hereinafter disclosed may be used to insulate any structural member with any kind of preformed insulative material, provided the member has a projecting edge portion which the clip of the invention may grip. Thus, beams, columns, and girders are particularly susceptible to use with the invention. For purposes of illustration only, the particular disclosed form of the insulation is mineral wool felt of the type disclosed in the aforesaid commonly owned application.

As hereinafter used, terms such as "vertical", "transverse", "longitudinal", and other words of orientation, are used and construed in connection with orientations of the variously identified elements as they are assembled in a protected combination.

Figure 1:
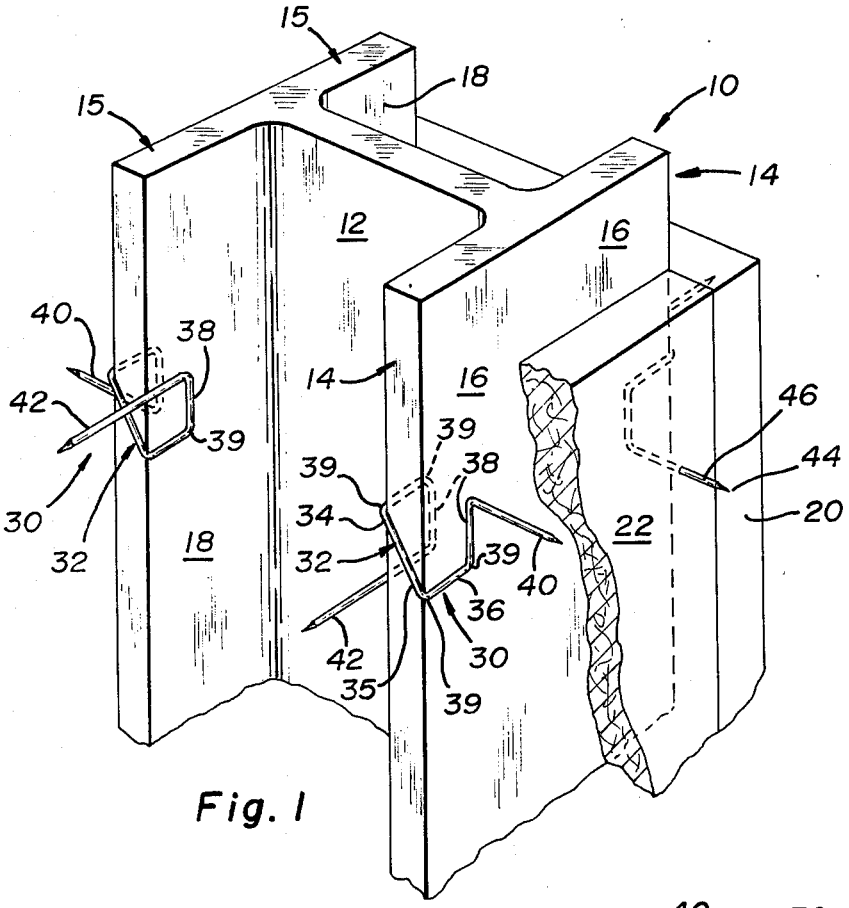
FIG. 1 is a fragmentary perspective view of a structural member protected in accordance with the invention.

FIG. 1 illustrates a structural beam such as an I-beam 10, positioned as a column, having an elongate web portion 12 and two sets of projecting edge portions or side flanges 14 and 15. Each of the side flanges has an outwardly directed, exposed face 16 and an inwardly directed face 18. Preformed layers or sheets 20 and 22, here shown to be mineral wool felt, are attached in place, adjoining and disposed about the flanges by means of the clips 30, described below.

The mineral wool comprising the layers 20 and 22 preferably is any bunched amorphous elongated filaments having been made predominantly from iron, copper, or lead blast furnace slag, and having a composition comprising silicon dioxide and metallic oxides, the percentage by weight of the metallic oxides being greater in total than the percentage of silicon dioxide. For example, a representative sample of mineral wool commerically available from United States Gypsum Company has an analysis of 39% (by weight) of $SiO_2$, 11.86% of $Al_2O_3$, 37.98% of CaO, 8.94% of MgO, and 1.01% of $Fe_2O_3$. Conveniently, such wool is applied to the member 10 in preformed semirigid sheets, which sheets are conventionally made through the use of a phenolic binder. For economic reasons, the density of the sheets is preferably less than about 10 pcf. It has been found that these felt sheets will retain their fire protective integrity when attached to a structural member subjected to the heat of a fire, thereby insulating the member against the heat of the fire. As is apparent from FIG. 1, preferably one layer 20 bridges the two spaced apart flanges 14 and 15, and another layer 22 is positioned adjoining the surface formed by adjacent flanges 14 and 15. Other layers or sheets, not shown, complete the encirclement of the structural member.

Although only single sheets or layers are shown adjacent to each side of the structural member, it will be recognized that for any such side, a plurality of layers may be positioned by impaling them over the clips. Also, it will be appreciated that other forms of inorganic fibrous materials may be used in place of, or in addition to, mineral wool felt.

Figure 2:
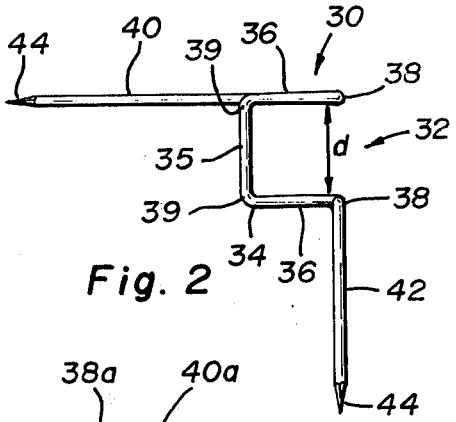
FIG. 2 is a plan view of the clip shown in FIG. 1.

Turning now to clip 30, shown in detail in FIG. 2, the clip comprises an edge gripping portion 32 and two elongate impaling projections or prongs 40 and 42. By "edge gripping portion" as used herein, it is meant a portion of the clip which grasps the edge portion of the structural member, either by contacting one of the faces 16 and 18, or, and preferably, by contacting both. As shown in the embodiment, portion 32 includes a pocket bent so as to define an elongate *c*-shaped member or bight 34 having a back portion 35 and two legs 36 joined by generally parallel extension portions 38. The portion 32 thus includes four generally right-angle bends 39 (FIG. 1). The portions 38 may also be considered to be extensions of the projections 40 and 42. The projections are angled with respect to each other and preferably terminate in points 44 for easy penetration of the felt. Because layers 20 and 22 are placed in a perpendicular relationship, as dictated by the overall rectangular configuration of the beam 12, the projections 40 and 42 generally extend in directions which are mutually perpendicular. Furthermore, they lie in non-coincident planes. As the shape of the beam is altered, however, this angular relationship will be altered, as will be appreciated.

Conventional cap members or heads, not shown, preferably are mounted over the points 44 after the felt is impaled, to complete the assembly. Alternatively, the exposed portions 46 (FIG. 1) of the projections 40 and 42 may be bent over to hold the felt in place.

The clips 30 are preferably mounted or attached at periodic intervals vertically along the protected member, as desired.

The clip is formed from a material, such as steel, which gives to portion 32 a resiliency such that it may be spread apart to accommodate a side flange 14 or 15 within the pocket, and thereafter spring back to grip the faces 16 and/or 18 of the flange. Thus, prior to assembly, the distance *d* between portions 38 is preferably less than the width of the side flange upon which it is mounted. Because of the construction of the bight 34, portions 38 may be forced apart a considerable distance, while still retaining their parallel relationship and the desired angular relationship of projections 40 and 42. Specifically, the clip can be attached to a side flange the width of which is between a value slightly greater than *d*, to a value which equals the inside length of portion 35 of the bight 34.

It will be appreciated that the three-dimensional extension of the clip, as provided for by bight 34 and extensions 38, serves to prevent it from tipping over or twisting in place when forces are exerted upon it.

As one example, and one example only, a clip formed from hard drawn steel wire about 14⅛inches long and having a diameter of about 0.105 inches may be bent so that distance *d* equals about 5/16 inches and the inside length of portion 35 is about 2 inches. Portions 38 may be knurled, not shown, to increase the grip which these portions have on the faces 16 and/or 18 of the side flanges.

A column fire test at Underwriters' Laboratories, Inc. verified that such clips 30 provide sufficient attachment of mineral wool felt about two inches thick and about 8 pcf density installed around a WIOX49 steel column to meet the ASTM Standard E119 time-temperature requirements for a 2-hour column fire rating. As indicated in the aforedescribed application Ser. No. 103,231, higher ratings can be achieved with felt layers 20 and 22 that are thicker.

Figure 3:
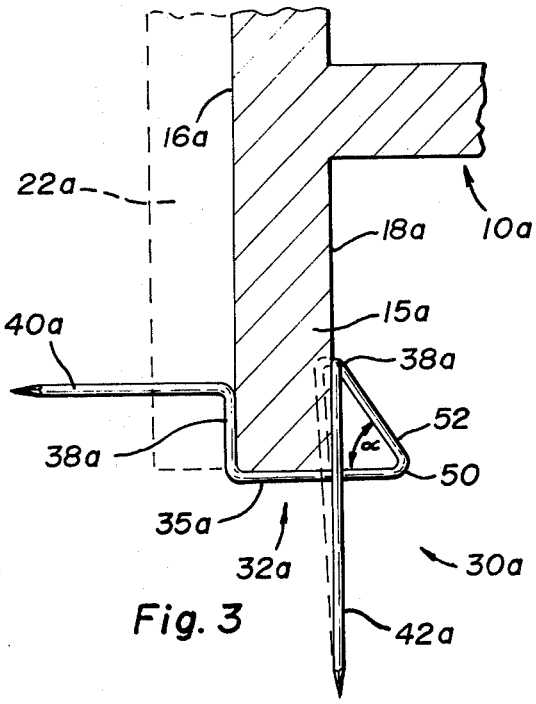
FIG. 3 is a fragmentary plan view, partially in section, illustrating an alternate embodiment of the invention.
Figure 4:
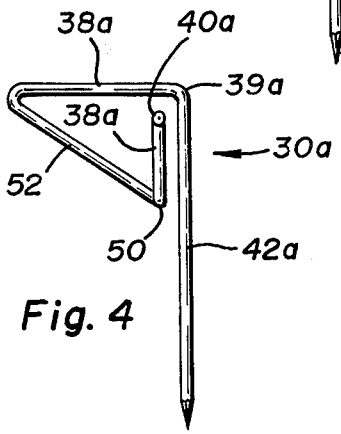
FIG. 4 is a side elevational view of the clip shown in FIG. 3.

Turning now to FIGS. 3 and 4, there is illustrated an alternate embodiment wherein the impaling projections are positioned so as to lie in transverse planes which are almost coincident. Parts similar to those previously described bear the same reference numeral, to which the distinguishing suffix *a* has been added. Thus, a structural member **10*a* has attached to the edge portions or side flanges 15*a* thereof, a clip 30*a* over which felt layers of insulation are impaled and held as described in the previous embodiment. As before, the clip comprises an edge gripping portion 32*a* and impaling projections 40*a* and 42*a*. However, the pocket formed by portion 32*a*, and its connection to projection 42*a* differ in the following manner. That is, the pocket is an elongate member having a back portion 35*a* extending from extension 38*a* transversely across the edge surface of the flange, and then outwardly away from face 18*a* of the side flange. Thereafter, it is bent at 50 out of the plane defined by projection 40*a* and back 35*a*, to form an included angle "alpha" which is preferably less than about 90°, and a leg 52 extends back towards face 18*a* where it joins extension 38*a*. This extension 38*a* is in contact with face 18*a*, and joins projection 42*a* at a bend 39*a***.

The angle alpha fives a three-dimensional extension to the clip to prevent it from twisting. Because the bend 50 and leg 52 are positioned between the inwardly directed faces **18*a* of the side flanges the outward extension of back portion 35*a* does not interfere with the flush attachment of insulation layer 22*a* (shown in phantom) to face 16*a***.

As shown in phantom, the clip clamps onto the member side flange by virtue of the resiliency in portion **32*a*, particularly at bend 50**. The phantom position represents, approximately, the shape of the clip in its unrestrained, unclamped form.

Figure 5:
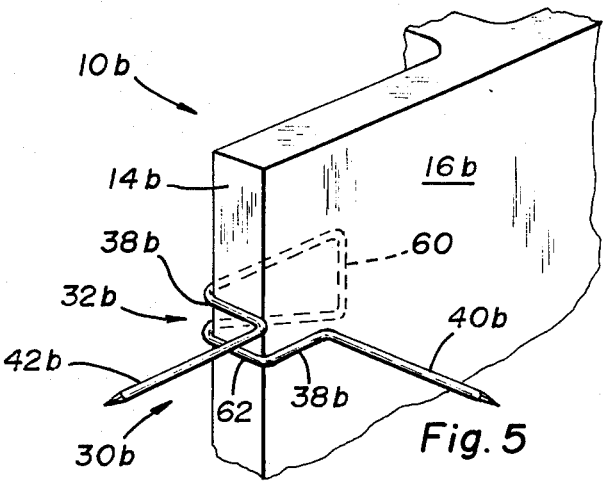
FIG. 5 is a fragmentary perspective view of still another embodiment of the invention.
Figure 6:
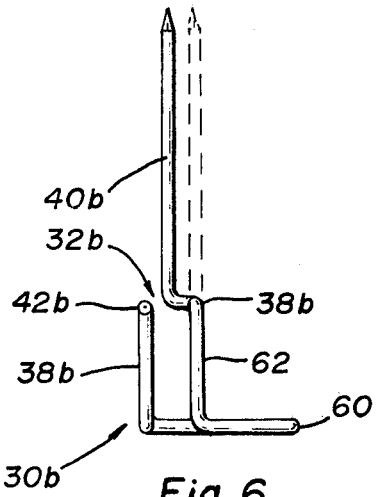
FIG. 6 is a side elevational view of the clip shown in FIG. 5.

FIGS. 5 and 6 illustrate still another embodiment, wherein the pocket includes a partially closed loop. Parts similar to those previously described bear the same reference numeral to which the distinguishing suffix *b* is appended. Thus, edge portion or side flange **14*b* has insulation layers (not shown) attached thereto by clip 30*b*. As before, the flange 14*b* is inserted into the edge gripping portion 32*b*, which is positioned between and is joined to impaling projections 40*b* and 42*b*. The portion 32*b* comprises extensions 38*b* joined to an elongate member bent in the shape of a partially closed loop 60 and a leg 62 bent with respect to loop 60, which leg 62 crosses the edge surface of the side flange. Loop 60 thus is generaly planar, and the clamping action of the clip arises out of the resiliency of the connection of the loop to the rest of the clip, as will be appreciated. Extension 38*b* joined to projection 40*b* may be skewed out of a transverse plane, so as to locate projection 40*b* closer to the plane of projection 42*b*. Or, extension 38*b* may extend generally transversely across face 16*b* of the member 10*b*, parallel to projection 42*b*, so that a greater spacing is achieved between the impaling projections, as shown in phantom, FIG. 6**.

Figure 7:
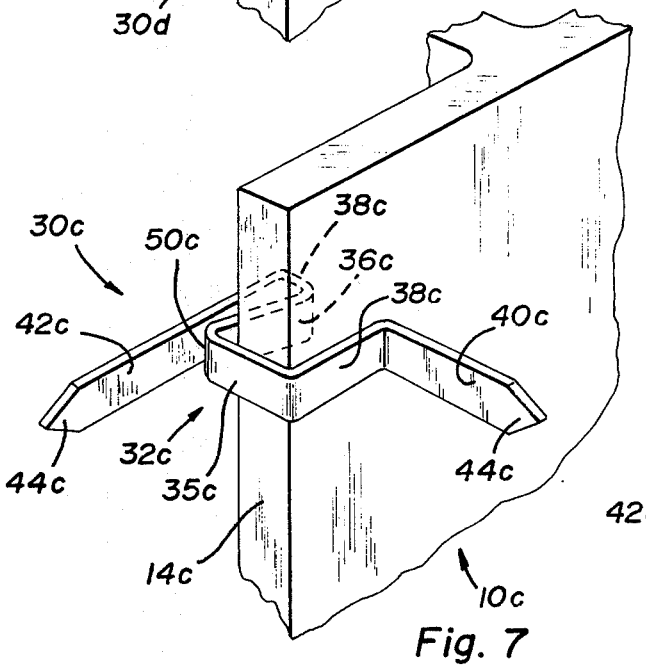
FIG. 7 is a fragmentary perspective view similar to FIG. 5, but illustrating yet another embodiment of the invention.
Figure 8:
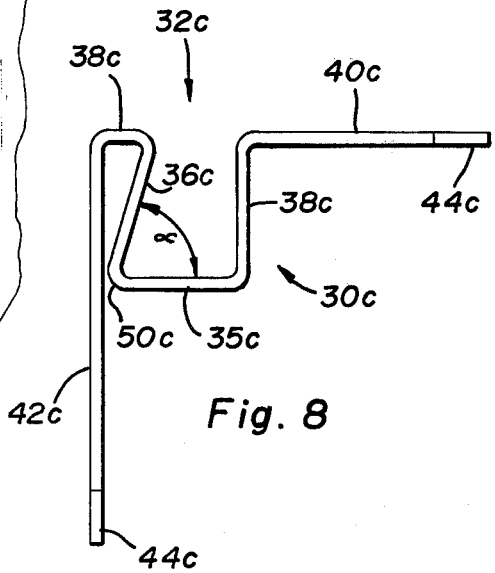
FIG. 8 is a plan view of the clip shown in FIG. 7.

FIGS. 7 and 8 illustrate yet another embodiment, wherein sheet metal is used to form the clip in lieu of the wire used in all the previously described embodiments. Parts similar to those previously described bear the same reference numeral to which the distinguishing suffix *c* has been added. Thus, member **10*c* has attached to it layers of insulation (not shown) by means of clip 30*c* self-attached to side flange or edge portion 14*c*. As before, the clip comprises an edge gripping portion 32*c* and impaling projections 40*c* and 42*c*. The portion 32*c* forms a pocket which is joined to extensions 38*c*, which in turn terminate in the impaling projections. The pocket is defined by an elongate member having a back portion 35*c* and a leg 36*c* which is bent from the back portion at 50*c* to form an included angle alpha of less than about 90°. It is this angle which is resiliently altered to clamp the clip onto the side flange. The projections 40*c* and 42*c* may be provided with points 44*c*** for easier penetration of the insulation layers.

It will be recognized that the clip in all of the above embodiments is self-attaching. That is, the clip requires no additional securing means or securing step such as welding, to attach the clip to the structural member. A further advantage achieved by the invention is that the self-attachment is readily releasible, in the event the location of the clip need be changed.

The method of assembling the insulation about the structural member will be readily apparent from the preceding details. That is, the clips are first clamped onto the edge portion of the member with the impaling projections or prongs projecting outwardly away from the member. The insulation is then impaled over the prongs, each layer or sheet protecting a face or surface of the edge portion and of the member.

Figure 9:
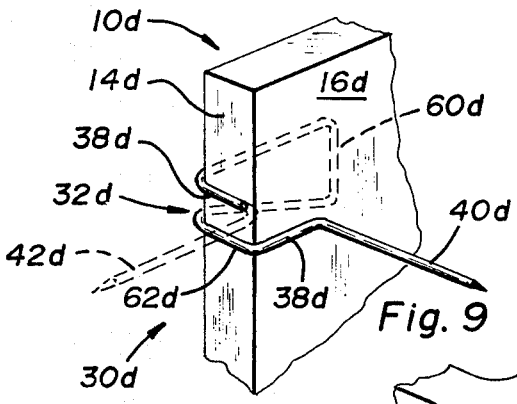
FIG. 9 is a fragmentary perspective view of a further embodiment.

FIG. 9 illustrates the wire form of the invention wherein, if desired, only a single impaling projection is clamped onto the structural member, for attaching the insulation. Parts similar to those previously described bear the same reference numeral to which the distinguishing suffix *d* has been added. Thus, the structural member **10*d* has a projecting edge or side flange 14*d* to which a clip 30*d* is self-attached. As with the other wire forms, the clip has a cross section with a generally uniform diameter or thickness which is approximately equal to the width of the wire throughout its length. Edge gripping portion or pocket 32*d* incorporates a loop 60*d* and leg 62*d* which are identical to that shown in the embodiment of FIG. 5, as is linearly extending impaling projection 40*d* connected to the pocked by extension 38*d*. The pocket thus is shaped, as in the case of the other wire forms of the invention, so that the wire member lies in more than one general plane, giving the clip stability. Alternatively, it will be apparent that leg 42*d*, shown in phantom, can be the prong that is used, with leg 40*d*** removed.

Although the invention has been described in connection with certain preferred embodiments, it is not intended that it be limited thereto. Rather, it is intended that it cover all alternate arrangements, equivalents, and embodiments as may be included within the scope of the following claims.

What is claimed is:

1. A unitary clip formed of a single piece of metal for attaching layers of preformed insulation to a structural member having a projecting edge, the clip comprising a generally U-form edge gripping portion having a back portion and two legs extending therefrom, and two elongate pointed impaling projections operatively connected thereto, said projections being angled with respect to each other, one of said projections being doubled back with respect to the leg to which it is operatively connected and extending substantially parallel and oppositely directed with respect thereto, and the other of said projections extending substantially perpendicular to an imaginary plane passing through the leg to which it is operatively connected and completely to one side of said plane, whereby the clip may secure a plurality of sheets of preformed insulation about a structural member by gripping the edge thereof without the use of any additional fastening means.

2. The clip as defined in claim 1, wherein said edge gripping portion is a bent elongate member, and wherein said projections each comprise a terminal portion joined to and extending from one end of said edge gripping portion.

3. The clip as defined in claim 2, wherein one of the bends in said elongate member forms an included angle of less than about 90°.

4. The clip as defined in claim 1, wherein said edge gripping portion is characterized by a pocket joined to the impaling projections, said gripping portion having a resiliency sufficient to permit it to clamp the edge within the pocket.

5. The clip as defined in claim 4, wherein said pocket is a C-shaped bight joined to and disposed between said impaling projections.

6. The clip as defined in claim 4, wherein said pocket is characterized by a partially closed loop extending generally in a single plane, said loop being connected to the remainder of the clip by bent portions, whereby the loop may be bent with respect to the rest of the clip to spring mount the clip on a flange.

7. The clip as defined in claim 1, wherein said projections lie in non-coincident planes.

8. In combination, a structural member having a projecting edge, a preformed insulation disposed about the member to protect it from fire, and a unitary clip formed of a single piece of metal for securing the insulation to the member, the clip having a generally U-form edge gripping portion having a back portion and two legs extending therefrom clamping the clip onto said edge, and pointed impaling projections operatively connected to said edge gripping portion, said projections being angled with respect to each other, one of said projections being doubled back with respect to the leg to which it is operatively connected and extending substantially parallel and oppositely directed with respect thereto, and the other of said projections extending substantially perpendicular to an imaginary plane passing through the leg to which it is operatively connected and completely to one side of said plane, said insulation being impaled over said projections so as to be disposed about said projecting edge.

9. The combination as defined in claim 8, wherein said projections lie in non-coincident planes.

10. The combination as defined in claim 8, wherein said portion comprises two parallel extensions from said projections joined by a bridging, generally C-shaped bight extending across said edge between said parallel extensions.

11. The improved assembly as defined in claim 8, wherein said member edge includes an exposed, outwardly directed face and an inwardly directed face, and wherein said portion is mounted so as to extend in contact with said exposed face, and outwardly away from said inwardly directed face before terminating in contact with the same at the juncture of the gripping portion with one of said projections, whereby the outward extension of said portion does not interfere with the flush attachment of said insulation adjoining said exposed face.

* * * * *